367-93 $$$ SR
E245K XR 4,106,003

United States Patent [19]
Otani

[11] 4,106,003
[45] Aug. 8, 1978

[54] SIGNAL TREATMENT CIRCUIT FOR BURGLAR ALARMS

[75] Inventor: Hiroaki Otani, Kawasaki, Japan

[73] Assignee: Nippon Prosensor Co., Ltd., Kawasaki, Japan

[21] Appl. No.: 747,997

[22] Filed: Dec. 6, 1976

[51] Int. Cl.² ..... G08B 13/24
[52] U.S. Cl. ..... 340/530; 340/558
[58] Field of Search ..... 340/261, 258 A, 258 B, 340/309.1; 324/188, 181

[56] References Cited

U.S. PATENT DOCUMENTS

| | | | |
|---|---|---|---|
| 3,459,961 | 8/1969 | Ravas | 340/258 A |
| 3,838,408 | 9/1974 | McMaster | 340/258 A |
| 3,866,198 | 2/1975 | Cohen | 340/258 A |
| 3,962,696 | 6/1976 | Smith et al. | 340/261 |

*Primary Examiner*—Glen R. Swann, III
*Attorney, Agent, or Firm*—Blanchard, Flynn, Thiel, Boutell & Tanis

[57] ABSTRACT

In burglar alarms in which ultrasonic waves are transmitted into a protected space and reflected to a receiver which detects disturbances in the reflected waves caused by an intruder to actuate the alarm, the alarm might be actuated not only by an illegal intruder but also by a short pulse-type vibration. For such reason, the present invention is so designed not to be actuated by a short vibrations with a timer being inserted so as to be actuated only by an input signal continuing for more than a fixed time (practically 0.7 seconds). Further, when such signal continues for more than a fixed time and contains a sound of a telephone bell containing a high frequency component, the high frequency component controls a switching element, permitting a setting time of the timer to extend over a telephone ringing time, thus arranging the alarms not to operate.

7 Claims, 7 Drawing Figures

SIGNAL TREATMENT CIRCUIT FOR BURGLAR ALARMS

FIELD OF THE INVENTION

The present invention, in burglar alarms utilizing ultrasonic waves, relates to a circuit of treating an input signal so as not to actuate the alarms except when an illegal intruder has intruded.

DESCRIPTION OF THE PRIOR ART

The known burglar alarms utilizing ultrasonic waves will transmit ultrasonic waves from the wave transmitting oscillator installed on ceilings, etc. and receive the waves reflected from doors, windows, floors, walls, etc. by the wave receiving oscillator. When an illegal intruder comes into a room, the received signal will be disturbed by his movement therein, so it will become such a trigger signal as to actuate a switching element of, for instance, a transistor, thus ringing the alarms. However, there is a possibility that it might actuate due to noises such as vibrations brought by passing of automobiles, earthquakes and others than by an illegal intruder.

SUMMARY OF THE INVENTION

An object of the present invention is to cause the alarms not to be actuated by environmental vibrations often present in everyday life. In view of the fact that most of these environmental vibrations are of very short pulse style, a timer will be inserted so that such alarms will actuate only if an input signal continues for more than a fixed time. Specifically, when an input signal enters and a transistor becomes conductive, then a charging load of a capacitor constituting a timer will discharge gradually through a resistor, and only when an input signal continues for more than 0.7 seconds, it will actuate an output circuit at the next stage to allow the alarm to actuate. With such procedures, the actuation of the alarms by a short pulse environmental vibration can be prevented.

Another object of the present invention is to arrange the alarm not to actuate even by telephone ringing. A sound of a telephone bell contains ultrasonic waves, which will be detected by the wave receiving oscillator, so the alarm might actuate by ringing of this telephone bell. Normally the telephone rings for a fixed time (in Japan 1 second) and stops for a fixed time (in Japan 2 seconds). For this reason, as the simplest method, if a setting time of a timer is set for more than 1 second (e.g. 1.2 seconds), its malfunction can be avoided. Where a setting time of the timer is too long, however, a detecting response for an illegal intruder will become dull. Accordingly, as in the foregoing, it is not desirable that a setting time of the timer would exceed 0.7 seconds. Taking into consideration that while the variation in the frequency of a received signal due to a human movement is at most 200 Hz, a sound of a telephone bell contains a higher frequency, when a noise signal containing such high-frequency has been received, such high-frequency signal is detected through a filter, arranged to permit a capacitor to discharge gradually by controlling a switching element with the signal, thus prolonging a setting time of the timer longer than a time when the telephone is ringing. As a result, with a sound of a telephone bell the alarms will not actuate.

A still another object of the present invention is to arrange the alarms not to activate for short-interval (below 0.7 seconds) intermittent input signals. A timer takes a time until the voltage will reach an actuating point of a transistor at the next stage as its setting time, taking advantage of a charging or discharging characteristic of a capacitor. Nevertheless, in case of intermittent input signals, there is a case when a next input signal might come in before a capacitor discharges or is charged fully, that is, before the capacitor returns to its initial condition, therefore a setting time of the timer might become shorter gradually. For this reason, in case of setting the timer, taking advantage of a discharging or charging characteristic of a capacitor or in case of returning the timer to its initial condition due to the elimination of an input signal, this invention allows a switching element to be conductive, also allows the capacitor to be charged or discharge quickly under the low resistance condition, and makes its rise or fall characteristic in a sharp angle. With such arrangement, even for intermittent input signal an error in a setting time of the timer can be prevented.

DESCRIPTION OF THE PREFERRED EMBODIMENTS

Figure 1:
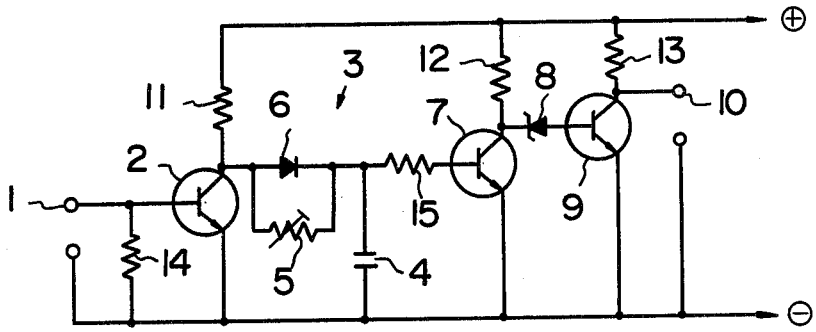
FIG. 1 is a fundamental electric wiring diagram of the present invention.

The fundamental diagram of the present invention will be described in accordance with the accompanying FIG. 1.

Reference numeral 1 designates an input terminal, which will be connected to a base of a transistor 2, a collector of which will be connected to a timer 3. The timer 3 has taken advantage of charging and discharging characteristics of a capacitor 4 and a semi-fixed resistor 5, and a diode 6 is connected in series to the resistor 5 for quick charging. The timer 3 is further connected to a transistor 7, a Zener diode 8 and a transistor 9 of an output circuit, and a collector of this transistor 9 is connected to an output terminal 10. Reference numerals 11, 12 and 13 are collector resistors, and 14 and 15 indicate base resistors.

In such a construction, when a power source is first turned on the capacitor 4 of the timer 3 will be charged fully through the collector resistor 11 and the diode 6.

Figure 2:
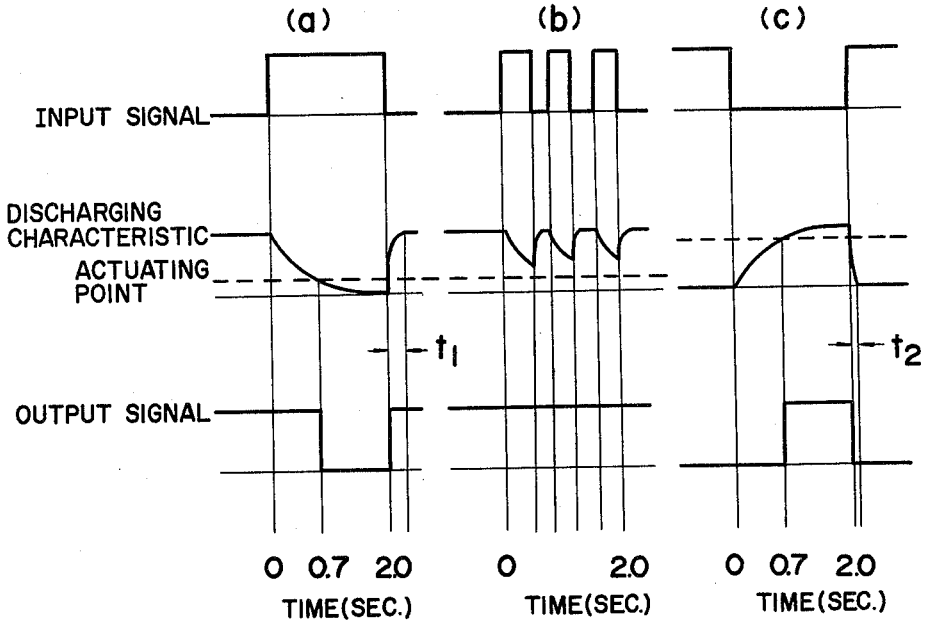
FIG. 2 (*a*), (*b*) and (*c*) are a discharge curve and an output wave form drawing of a capacitor in regard to an input signal and a wave form respectively.

When an input signal is impressed into the input terminal 1, then the transistor 2 will be conductive and the charge on the capacitor 4 of the timer 3 will be discharged through the resistor 5 and transistor 2. If an input signal, as shown in FIG. 2 (*a*), continues for more than 0.7 seconds, the voltage on the capacitor 4 will reach an actuating point, then the transistor 7 will be shut off. By shut-off of this transistor 7 the Zener diode 8 will be conductive, the transistor 9 will also be conductive, and an output will appear on the output terminal 10, thus starting to ring the alarm. When the input signal is eliminated, the transistor 2 will be shut off, so the capacitor 4 will be charged quickly through the resistor 11 and diode 6, the transistor 7 will be conductive, the transistor 9 will be shut off, thus eliminating the output signal. The alarm, once starting to ring, will continue to sound until a stop switch is turned on.

Next, as given in FIG. 2 (*b*), where an intermittent input signal shorter than a setting time of the timer 3 has entered, a next input signal will come in before a charging voltage of the capacitor 4 of the timer 3 reaches an actuating point, so the capacitor 4 will be recharged, and consequently an output signal will not appear.

In the circuit shown in FIG. 1, charging to the capacitor 4 is conducted through the collector resistor 11, so that, as shown in FIG. 2 (*a*), until completion of charging, it will take some time ($t_1$). In order to shorten this time as much as possible, connect the diode 6 in the reverse direction and an input signal will be made as a negative signal as shown in FIG. 2 (*c*). In this case, a setting time of the timer (3) will take advantage of a charging curve through the resistors 11 and 5 of the capacitor 4. And when an input signal is eliminated, the charge on the capacitor 4 will be discharged through the reversely connected diode 6 and the transistor 2, so it will return to its initial condition within a short time ($t_2$).

The timer 3 can be set its setting time as desired by varying the semi-fixed resistor 5.

Now, reference will be made to a practical embodiment in accordance with FIG. 3.

Figure 3:
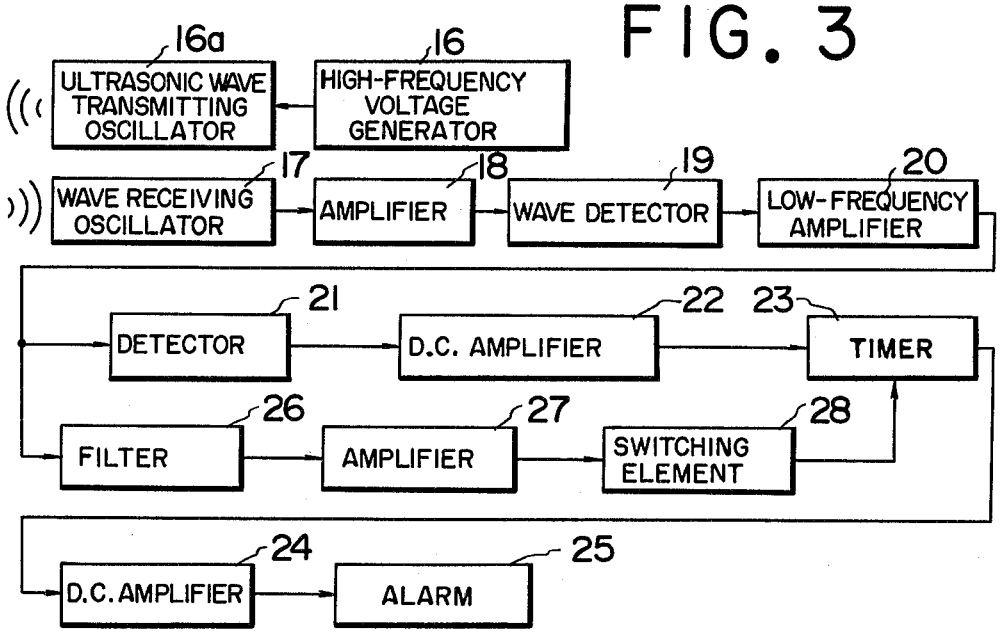
FIG. 3 is a block diagram of a burglar alarms in accordance with the present invention.

In FIG. 3 number 16 is a high-frequency voltage generator, which is connected to an ultrasonic wave transmitting oscillator 16a emitting ultrasonic waves utilizing an electric distorsion effect, these being mounted on ceilings and the like so that ultrasonic waves will radiate toward places where an illegal intruder is liable to pass through, such as doors, windows, floors, walls, gates, etc. Number 17 indicates a wave receiving oscillator receiving reflected ultrasonic waves, which is connected in turn to an amplifier 18, a wave detector 19 and a low-frequency amplifier 20. The output terminal of this low-frequency amplifier 20 is divided into 2 branches; one is connected to an alarm 25 through a detector 21, a D.C. amplifier 22, a timer 23, a D.C. amplifier 24 and a self-maintaining relay therein, and the other is connected to a filter 26 passing only high-frequency components which are noise signals, an amplifier 27 and a switching element 28. When detecting a bell of a telephone, the switching element 28 is controlled so as to extend a setting time of said timer (23).

Now, reference will be made to an integral part in detail in accordance with FIG. 4.

Reference numeral 20 designates the afore-mentioned low-frequency amplifier, which is connected in turn to the aforementioned detector 21 consisting of a field effect transistor 29, a resistor, a capacitor and a diode, the afore-mentioned D.C. amplifier 22 mainly consisting of a transistor 30, the afore-mentioned timer 23 consisting of resistors 31 and 32, a capacitor 33 and a diode 34, and the afore-mentioned D.C. amplifier 24 mainly consisting of a transistor 35, and an output terminal 36 of this D.C. amplifier 24 is connected to said alarm 25. The afore-mentioned amplifier 20 is also connected in turn to the filter 26 (consisting of a capacitor) which passes only high-frequency waves, the amplifier 27 mainly consisting of transistors 37 and 38 and the switching element 28 consisting of the transistor 28, and a collector of this transistor 28 is connected to the above-mentioned resistor 32.

Next, the function will be described.

Figure 5:
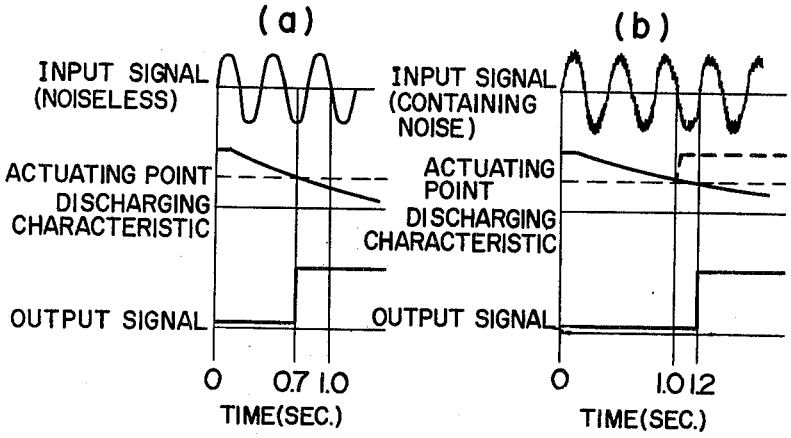
FIG. 5 (*a*) and (*b*) are a discharge curve and an output wave form drawing of a capacitor in regard to a noiseless input signal wave form and a noise-containing input signal wave form respectively.

As shown in FIG. 5 (*a*), assume that an output signal from the low-frequency amplifier 20, i.e. an input signal to the detector 21, contains only a low-frequency signal without high-frequency component noises and has been sent consecutively for more than 0.7 seconds. This input signal will not pass through the filter 26; therefore while the transistor 37 of the amplifier 27 is left conductive, the transistor 38 is left shut off. For this reason the switching element 28 is kept conductive and the resistor 32 of the timer 23 is grounded. On the other hand, inside the detector 21, a negative voltage is impressed to the gate of FET 29 by the afore-mentioned input signal, thereby FET 29 is shut off, so the Zener diode 39 will be conductive and the transistor 30 of the amplifier 22 will also be conductive. By the conductivity of this transistor 30 the charge on the capacitor 33 will be discharged through the resistor 31 and the transistor 30. The charge on this capacitor 33 will also be discharged through the resistor 32 and the switching element 28. Consequently, the discharging voltage of the capacitor 33 will reach an actuating point after a setting time (0.7 seconds) of the timer 23 to shut off the transistor 35, thereby an output signal will appear at the output terminal 36, thus starting to ring the alarm 25. When an input signal is eliminated, the transistor 30 will be shut off, the capacitor 33 will be charged rapidly through the diode 34, thereby the transistor 35 will be conductive, thus an output at the output terminal 36 will be erased. In this instance, however, the self-maintained alarm 25 continues to ring.

Next, as shown in FIG. 5 (*b*), assume that an input signal of the detector 21 contains noises of high-frequency component. A high-frequency component of the input signal will pass through the filter 26, the transistor 37 of the amplifier 27 will be shut down, the transistor 38 will be conductive, and then the switching element 28 will be shut down. For this reason, the resistor 32 of the timer 23 will depart from ground. On the other hand, inside the detector 21, same as in the foregoing, FET will be shut off, the transistor 30 will be conductive and the capacitor 33 will begin to discharge. Since this capacitor 33 will discharge only through the resistor 31 and the transistor 30, it will discharge more slowly than in case of FIG. 5 (*a*). For this reason, the time until the voltage of the capacitor 33 reaches an actuating point will be extended from 0.7 seconds to 1.2 seconds.

Here, where an input signal is a sound of a telephone bell, such cycle is repeated that the telephone will stop ringing temporarily 1.0 second before a preset time of 1.2 seconds of the timer has elapsed and after 2 seconds it will start to ring again. Accordingly, the capacitor 33 will be quickly charged again before an actuating point is reached, as shown with the dotted line in FIG. 5 (*b*), so there will not appear an output at the output terminal 36, thus the alarm 25 will not actuate. When a signal containing noises other than a sound of a telephone and yet an input signal continuing for 1.2 seconds enters, then an output signal will appear, so the alarm 25 will ring. What is considered as such a case, however, should be an emergency bell or other cases under emergency conditions, so no inconvenient matter should occur even when an output may appear and the alarm may ring.

Figure 4:
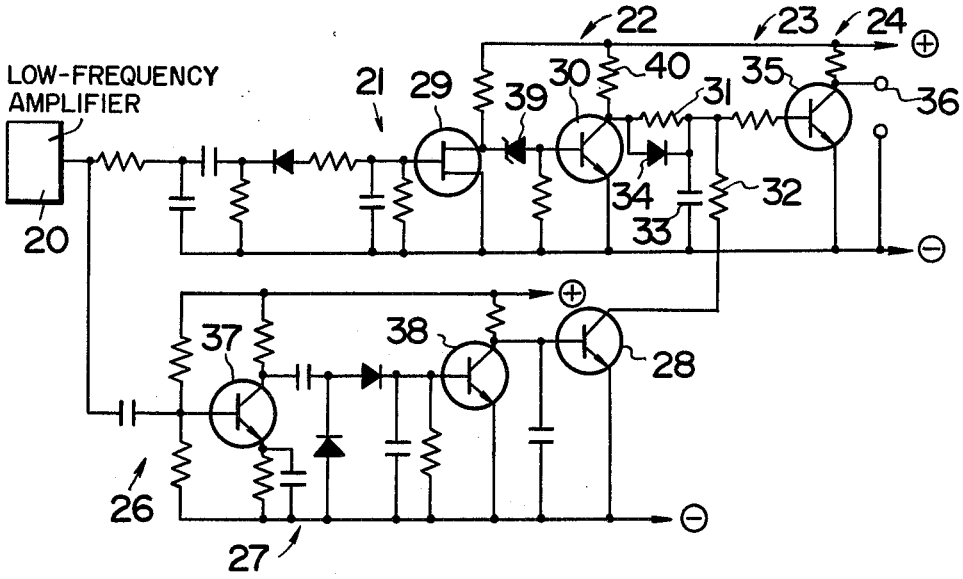
FIG. 4 is a practical wiring diagram of an integral part in FIG. 3.
Figure 3:
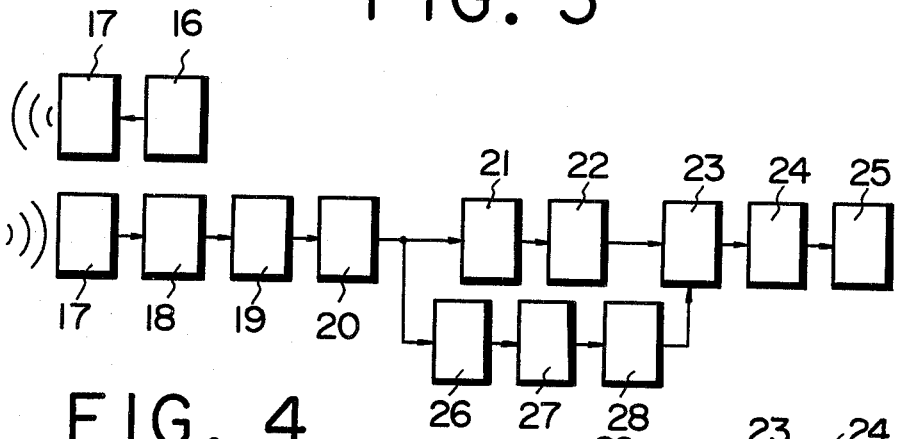
Figure 4:
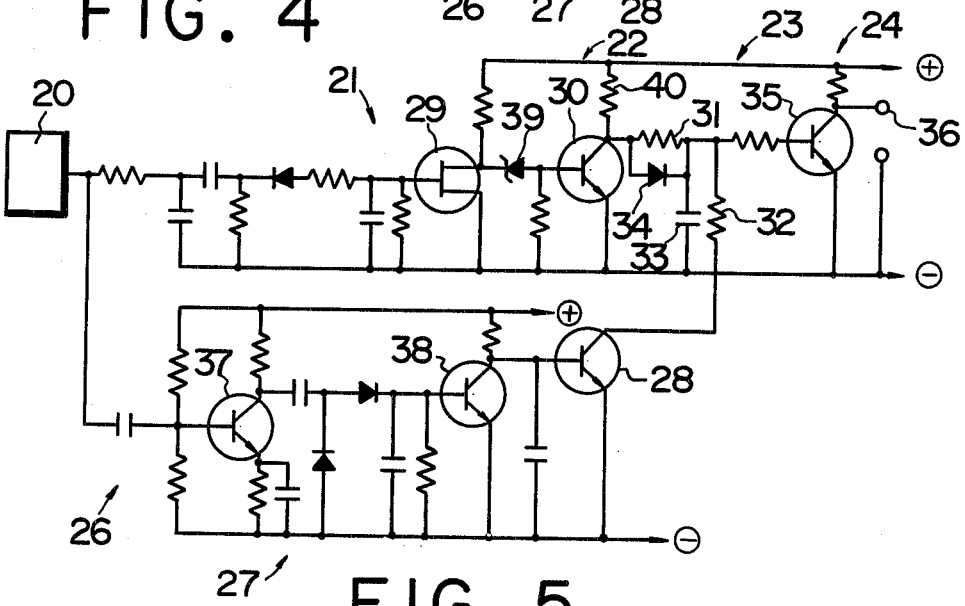
Figure 6:
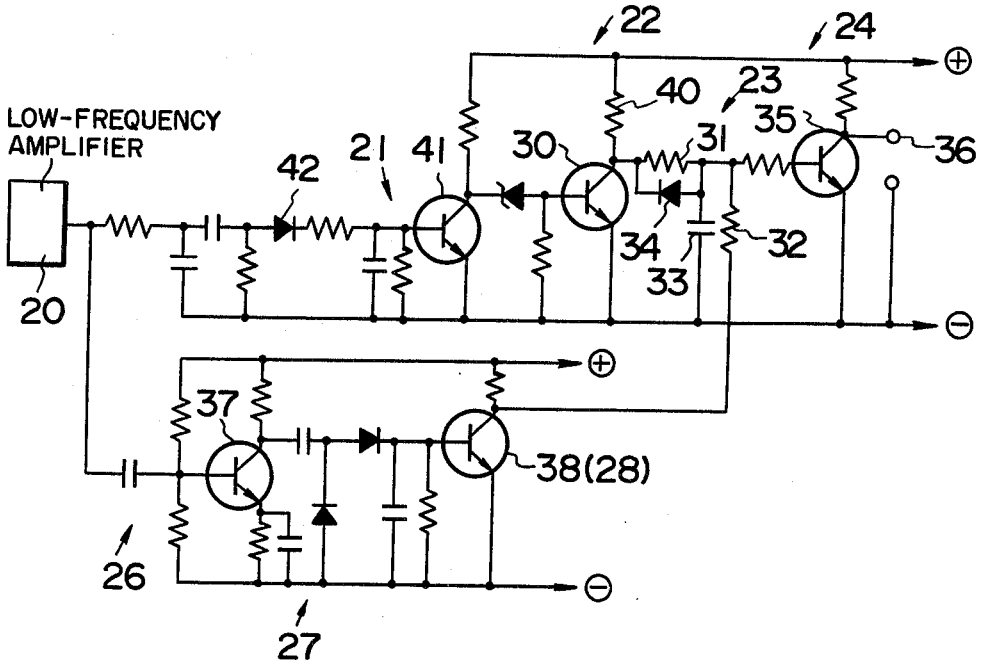
FIG. 6 is a practical electric wiring diagram showing another embodiment of an integral part.

Next, in the embodiment of FIG. 4, the timer 23 has utilized the discharging characteristics of the capacitor 33. For this reason, charging of capacitor 33 is conducted by way of the collector resistor 40, and its rising characteristic will become somewhat dull. In case of intermittent input signals, when a next input signal appears before being charged perfectly, the setting time of the timer 23 will become shorter gradually. On account of this matter, as FIG. 6, if the timer instead takes advantage of the charging characteristics of capacitor 33, the above-mentioned drawback can be eliminated. That is, the detector 21 utilizes the transistor 41 instead of FET 29 and the diode 42 is connected in reverse direction, the timer 23 connects the diode 34 in reverse direction, and further the function of the switching element 28 will utilize the transistor 38 jointly with the amplifier 27.

Figure 7:
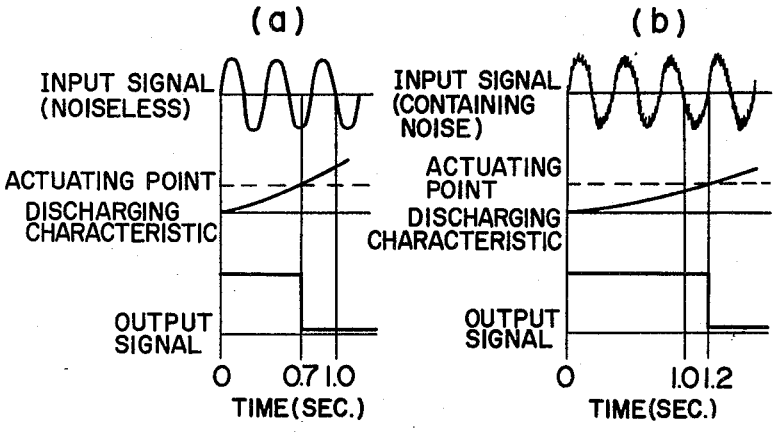
FIG. 7 (*a*) and (*b*) are a charging curve and an output wave form drawing of a capacitor in regard to a noiseless input signal wave form and a noise-containing input signal wave form respectively.

Under such construction, as shown in FIG. 7 (*a*), when an input signal without mixing any noise enters, the transistor 37 will be conductive, and the transistor 38 remains shut down, and thus the resistor 32 is ungrounded. On the other hand, since the transistor 41 will be conductive and the transistor 30 will be shut down, the capacitor 33 of the timer 23 will be charged gradually through the resistors 40 and 31, and will reach an actuating point after 0.7 seconds to permit the transistor 35 to be conductive, thus a negative output will appear at the output terminal 36.

Next, as in FIG. 7 (*b*), when an input signal mixed with noises enters, it will shut down the transistor 37 through the filter 26, the transistor 38 will be conductive and the resistor 32 will be grounded. On the other hand, the transistor 41 will be conductive and the transistor 30 will be shut down. Thereby, the capacitor 33 will be charged through the resistors 40 and 31, but as a part of current will flow through the resistor 32 and the transistor 38, so the capacitor 33 will be charged slowly. This charging voltage will reach an actuating point in 1 or 2 seconds, the transistor 35 will be conductive, thus an output will appear. Next, when an input signal is eliminated and the transistor 30 is thus made conductive, the charge on the capacitor 33 will be discharged quickly through the diode 34 and the transistor 30, its rising characteristic will become sharp and an adverse effect on the setting time by an intermittent input signal will be eliminated.

In the afore-mentioned embodiment, the setting time of the timer 23 has been described with practical figures, but the invention is not to be limited to these examples.

What I claim is:

1. In burglar alarms in which a wave receiving oscillator is so arranged to receive an ultrasonic wave signal transmitted from a wave transmitting oscillator when the latter signal is reflected by an object and alarms will ring immediately after obtaining an output by virtue of an input signal caused by a disturbance in a received signal characteristic of an illegal intruder, a signal processing circuit provided with a timer to provide an output only when the above-mentioned input signal continues for longer than a predetermined time, said signal processing circuit further being provided with a switching element which will be activated by a high-frequency component in an input signal and is operative to extend said predetermined time.

2. A signal processing circuit for burglar alarms as set forth in claim 1, in which the timer consists of a capacitor and 2 resistors connected in parallel to each other, switching elements being connected to each resistor, wherein when an input signal contains a high-frequency component, one switching element is shut down to discharge a charging load of the capacitor only through the other resistor in order to extend said predetermined time.

3. A signal processing circuit as set forth in claim 2, arranged in such a manner that a diode is inserted in parallel to a resistor and a quick charging will be conducted into the capacitor when one switching element is shut down.

4. A signal processing circuit for burglar alarms as set forth in claim 1, in which the timer consists of a capacitor, 2 resistors connected in parallel to each other and a diode inserted in parallel with one of said resistors, switching elements being connected to each said resistor, respectively, wherein when an input signal contains a high-frequency component, one switching element is shut down, while the other switching element will be made conductive to permit slow charging into the capacitor, and when the switching element is conductive followed by the elimination of an input signal, said switching element will discharge the capacitor quickly via the diode.

5. In burglar alarms in which a wave receiving oscillator is so arranged to receive an ultrasonic wave signal transmitted from a wave transmitting oscillator when the latter signal is reflected by an object and alarms ring immediately after obtaining an output by virtue of an input signal caused by a disturbance in a received signal characteristic of an illegal intruder, a signal processing circuit provided with a timer to produce an output when said input signal continues for longer than a predetermined time, in which said timer comprises a capacitor and two resistors connected thereto in parallel to each other, said resistors being connected to switching elements, one of said resistors being connected to a filter wherethrough a high-frequency component in a said input signal is passed, one of said switching elements being operable only when an input signal contains a high-frequency component for causing the charge on said capacitor to discharge only through the other resistor in order to extend said predetermined time.

6. A signal processing circuit according to claim 5, including a diode inserted in parallel to said other resistor and oriented to conduct into and quickly charge said capacitor when one of said switching elements is shut down.

7. A signal processing circuit according to claim 5, including a diode inserted in parallel to said other resistor and oriented to conduct away from said capacitor for discharging said capacitor quickly through said diode when one of said switching elements is conductive.

* * * * *